US005499617A

United States Patent [19]

Kitajima et al.

[11] Patent Number: 5,499,617

[45] Date of Patent: Mar. 19, 1996

[54] EVAPORATIVE FUEL CONTROL SYSTEM IN INTERNAL COMBUSTION ENGINE

[75] Inventors: Shinichi Kitajima; Hiroaki Muramatsu, both of Wako; Yoshihiko Kobayashi, Haga, all of Japan

[73] Assignee: Honda Giken Kogyo Kabushiki Kaisha, Tokyo, Japan

[21] Appl. No.: 405,249

[22] Filed: Mar. 17, 1995

[30] Foreign Application Priority Data

Mar. 18, 1994 [JP] Japan ..... 6-049194

[51] Int. Cl.[6] ..... F02D 41/14; F02M 25/08

[52] U.S. Cl. ..... 123/698

[58] Field of Search ..... 123/520, 674, 123/698

[56] References Cited

U.S. PATENT DOCUMENTS 4,683,861 8/1987 Breitkreuz et al. ..... 123/698
4,841,940 6/1989 Uranishi et al. ..... 123/694

FOREIGN PATENT DOCUMENTS 63-45442 2/1988 Japan .

*Primary Examiner*—Tony M. Argenbright
*Attorney, Agent, or Firm*—Nikaido, Marmelstein, Murray & Oram

[57] ABSTRACT

In an evaporative fuel control system in an internal combustion engine, a purge gas concentration is estimated by a purge gas concentration estimating device based on an air-fuel ratio correcting factor provided when a purge control valve is in its opened state and an air-fuel ratio correcting factor provided when the purge control valve is in its closed state. A lower limit value of an air-fuel ratio correcting factor, set by an air-fuel ratio correcting factor setting device, is determined by an air-fuel ratio correcting factor limit value setting device in accordance with the purge gas concentration estimated by the purge gas concentration estimating device. Thus, the lower limit value of the air-fuel ratio correcting factor can be varied depending upon the concentration of the purge gas, thereby setting an air-fuel ratio control range corresponding to the concentration of the purge gas.

7 Claims, 8 Drawing Sheets

EVAPORATIVE FUEL CONTROL SYSTEM IN INTERNAL COMBUSTION ENGINE

BACKGROUND OF THE INVENTION

1. Field of the Invention

The present invention relates to an evaporative fuel control system in an internal combustion engine, comprising a canister for adsorbing an evaporative fuel from a fuel tank, a purge control valve provided between an intake system of the engine and the canister, a purge control means for controlling the operation of the purge control valve to control the flow rate of a purge gas from the canister to the intake system, an exhaust gas concentration sensor provided in an exhaust system of the engine, an air-fuel ratio correcting factor setting means for determining an air-fuel ratio correcting factor in accordance with a detection value detected by the exhaust gas concentration sensor, and an air-fuel ratio control means for controlling the air-fuel ratio of an air-fuel mixture supplied to the engine by use of the determined air-fuel ratio correcting factor.

2. Description of the Prior Art

An evaporative fuel control system is conventionally known, for example, from Japanese Patent Application Laid-open No. 45422/88.

When the purging from the canister to the intake system is being carried out, the enrichment of the air-fuel ratio occurs. However, if a lower limit value of the air-fuel ratio is set constant, irrespective of the enrichment of the air-fuel ratio, the air-fuel ratio of the air-fuel mixture supplied to the engine is deviated from a target value because an air-fuel ratio correcting factor is maintained at the lower limit value. Thus, the exhaust gas purifying performance is reduced due to an over-enrichment. There is also a known system in which a problem produced in a fuel supply system (including a fuel pump, a pressure regulator, a fuel injection valve and the like) is detected, or the flow rate of the purge gas is reduced when the air-fuel ratio correcting factor, determined depending upon the detection value detected by the exhaust gas concentration sensor, becomes equal to or less than the lower limit value. However, if the lower limit value is set constant as described above, a misdetection may be caused during execution of the purging from the canister to the intake system, and a canister break-through may be produced due to a reduction in flow rate of the purge gas, in some cases. Particularly, due to an increase in size of the canister and an increase in flow rate of the purge gas, the air-fuel ratio correcting factor is liable to be decreased down to the lower limit value or less, with an attendant possibility of a misdetection and a canister break-through, immediately after the start of the purging from the canister, while remaining in an idle operation for a long time as well as immediately after the long idle operation time is stopped.

Therefore, in the known system (described in Japanese Patent Application Laid-open No. 45442/88), when the purging from the canister to the intake system is being carried out, the lower limit value of the air-fuel ratio correcting factor is always decreased. However, the degree of enrichment of the air-fuel ratio is varied depending upon the concentration of the purge gas, whereas the concentration of the purge gas is varied depending upon the operational state of the engine. In the system in which the lower limit value is always decreased during execution of the purge as described above, there is a problem that when the concentration of the purge gas is low, the lower limit value may be decreased, resulting in a reduced responsiveness of the control of the air-fuel ratio into a target air-fuel ratio.

SUMMARY OF THE INVENTION

Accordingly, it is an object of the present invention to provide an evaporative fuel control system in an internal combustion engine, wherein the lower limit of the air-fuel ratio correcting factor is varied depending upon the concentration of the purge gas, thereby making it possible to set an air-fuel ratio control range depending upon the concentration of the purge gas.

To achieve the above object, according to the present invention, there is provided an evaporative fuel control system in an internal combustion engine, comprising a canister for adsorbing an evaporative fuel from a fuel tank, a purge control valve provided between an intake system of the engine and the canister, a purge control device for controlling the operation of the purge control valve to control the flow rate of a purge gas from the canister to the intake system, an exhaust gas concentration sensor provided in an exhaust system of the engine, an air-fuel ratio correcting factor setting device for determining an air-fuel ratio correcting factor in accordance with a detection value detected by the exhaust gas concentration sensor, and an air-fuel ratio control device for controlling the air-fuel ratio of an air-fuel mixture supplied to the engine by use of the determined air-fuel ratio correcting factor. The evaporative fuel control system further includes a purge gas concentration estimating device for estimating a purge gas concentration based on an air-fuel ratio correcting factor provided when the purge control valve is opened and an air-fuel ratio correcting factor provided when the purge control valve is closed, and an air-fuel ratio correcting factor limit value setting device for determining a lower limit value of the air-fuel ratio correcting factor set by the air-fuel ratio correcting factor setting device in accordance with the purge gas concentration estimated by the purge gas concentration estimating device.

With the above arrangement, the purge gas concentration is estimated by the purge gas concentration estimating device based on the air-fuel ratio correcting factor provided when the purge control valve is in its opened state and the air-fuel ratio correcting factor provided when the purge control valve is in its closed state. The lower limit value of the air-fuel ratio correcting factor set by the air-fuel ratio correcting factor setting device is determined by the air-fuel ratio correcting factor limit value setting device in accordance with the purge gas concentration estimated by the purge gas concentration estimating device. Therefore, the lower limit value of the air-fuel ratio correcting factor can be varied depending upon the concentration of the purge gas, thereby setting an air-fuel ratio control range corresponding to the concentration of the purge gas.

The above and other objects, features and advantages of the invention will become apparent from the following description of a preferred embodiment in conjunction with the accompanying drawings.

DESCRIPTION OF THE PREFERRED EMBODIMENT

The present invention will now be described by way of a preferred embodiment in conjunction with the accompanying drawings.

Figure 1:
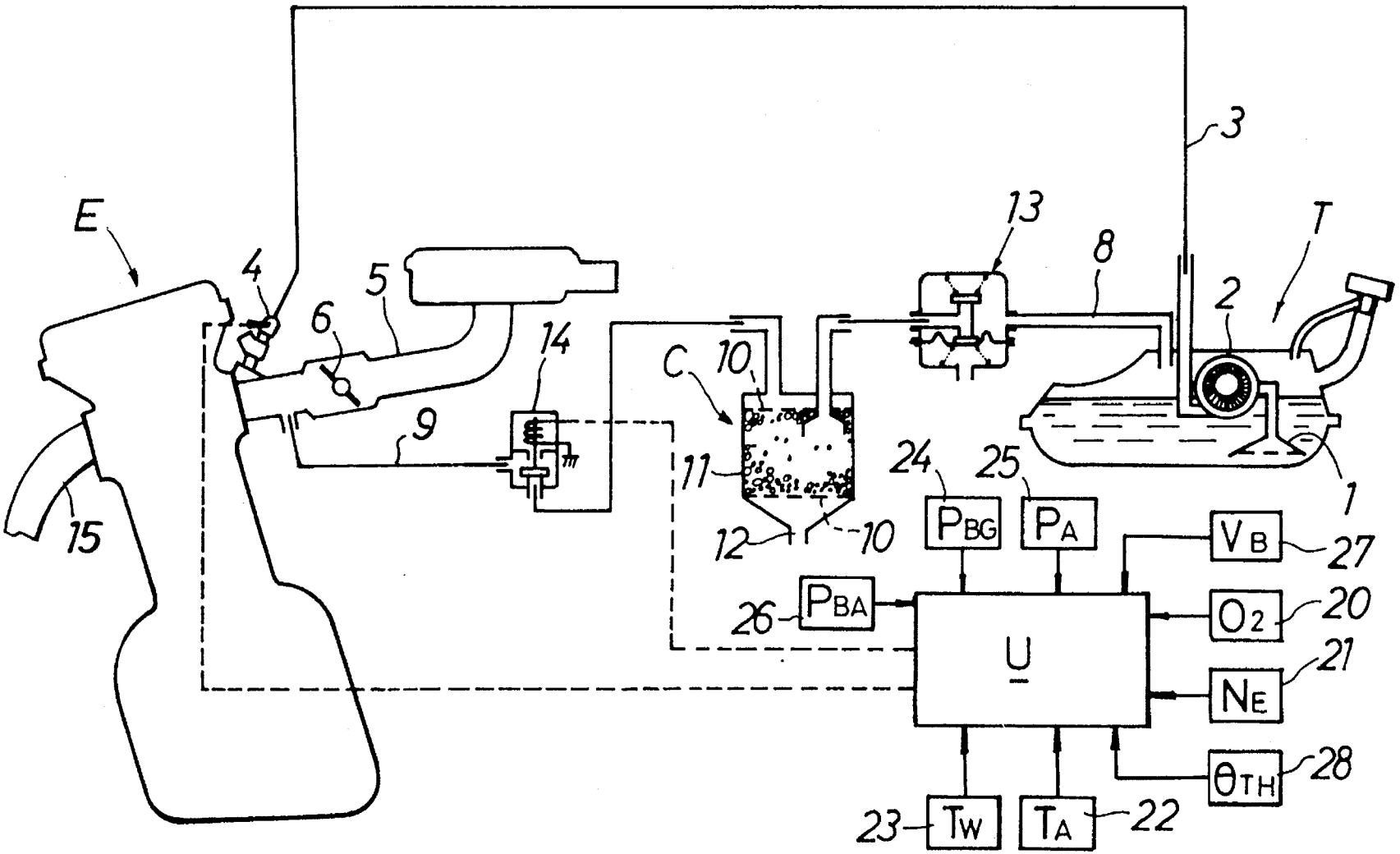
FIG. 1 is a diagrammatic illustration of the entire arrangement.

Referring first to FIG. 1, fuel is pumped from a fuel tank T through a filter 1 by a pump 2 and supplied through a fuel supply passage 3 to a fuel injection valve 4 of an internal combustion engine E. A charge passage 8 is connected to an upper space within the fuel tank T and also connected through a canister C to a purge passage 9. The purge passage 9 is connected to an intake system 5 in the engine E at a location downstream from a throttle valve 6.

The canister C is of an open-bottomed type with a lower end opened, and includes a pair of upper and lower filters 10, 10, and an activated carbon 11 accommodated between the filters 10, 10. The charge passage 8 on the side of the fuel tank T opens into the inside of the activated carbon 11, and the purge passage 9 on the side of the internal combustion engine E opens into a space above the upper filter 10. A space below the lower filter 10 opens to the atmosphere through an atmosphere opening passage 12.

A two-way valve 13 is incorporated in an intermediate portion of the charge passage 8. The two-way valve 13 is closed when the internal pressure in the fuel tank T increases and exceeds the atmospheric pressure by a predetermined value, and is opened when the internal pressure in the fuel tank T decreases lower than the internal pressure in the fuel tank T by a predetermined value so as to put the fuel tank T and the canister into communication with each other. When an evaporative fuel from the canister C is purged into the intake passage 5, the canister C may be brought into a negative pressure in some cases. In such a case, the two way valve 13 is retained in a closed state. A purge control valve 14 is also incorporated in an intermediate portion of the purge passage 9 for controlling the flow rate of the gas purged from the canister C to the intake system 5.

The fuel injection valve 4 and the purge control valve 14 are controlled by an electronic control unit U comprising a microcomputer. Connected to the electronic control unit U are: an oxygen concentration sensor 20 as an exhaust gas concentration sensor mounted in an exhaust system 15 of the internal combustion engine E to detect an oxygen concentration $O_2$ as an exhaust gas concentration in an exhaust gas from the internal combustion engine E; a revolution-number sensor 21 for detecting the number $N_E$ of revolutions of the internal combustion engine E; an intake gas temperature sensor 22 for detecting a temperature $T_A$ of an intake gas of the internal combustion engine E; a water temperature sensor 23 for detecting a temperature $T_W$ of cooling water of the internal combustion engine E; a first intake gas pressure sensor 24 for detecting an intake gas pressure $P_{BG}$ in the intake system 5 at a location downstream from the throttle valve 6 in the form of a gauge pressure; an atmospheric pressure sensor 25 for detecting the atmospheric pressure $P_A$; a second intake gas pressure sensor 26 for detecting an intake gas pressure $P_{BA}$ in the intake system 5 at a location downstream from the throttle valve 6 in the form of an absolute pressure; a battery voltage sensor 27 for detecting a voltage $V_B$ of the battery which drives the purge control valve 14; and a throttle opening degree sensor 28 for detecting an opening degree $\theta_{TH}$ of the throttle valve 6.

The electronic control unit U includes: an input circuit having a functions of shaping the waveform of an input signal from each of the various sensors 20 to 28 to correct the voltage level to a predetermined voltage level and converting the input signal into an analog signal value; a central processing circuit; a memory means for storing a calculating program carried out in the central processing circuit, a calculation result and the like; and an output circuit for outputting a driving signal to the fuel injection valve 4 and the purge control valve 14. Thus, the electronic control unit U calculates the signal from each of the sensors 20 to 28 according to a previously established program, controls the time of injection of the fuel from the fuel injection valve 4 by a feedback control or an open-loop control, and controls the opening and closing operations of the purge control valve 14.

During stoppage of the engine E, the purge control valve 14 is in a closed state. If the temperature in the fuel tank T rises in this state and the internal pressure increases, the two-way valve 13 is opened, thereby permitting the fuel vapor in the fuel tank T to flow through the charge passage 8 into the canister C, where it is adsorbed into the activated carbon 11, whereby the fuel vapor is prevented from being leaked to the outside. Moreover, the risen internal pressure in the fuel tank T escapes through the atmosphere opening passage 12 to the atmosphere and hence, the internal pressure in the fuel tank T is prevented from rising excessively. In addition, if the internal pressure in the fuel tank T is reduced with a reduction in temperature during stoppage of the engine E, the open air is introduced into the fuel tank T through a route reverse from the above-described route, thereby preventing the internal pressure in the fuel tank T from being excessively reduced.

If the purge passage 9 is opened by the purge control valve 14 after the start of the internal combustion engine E, air introduced through the atmosphere opening passage 12 of the canister C, in response to the negative pressure in the intake passage 5, is drawn into the intake passage 5, whereby the fuel adsorbed in the activated carbon 11 in the canister C is entrained on the air and purged into the intake passage 5.

Figure 2:
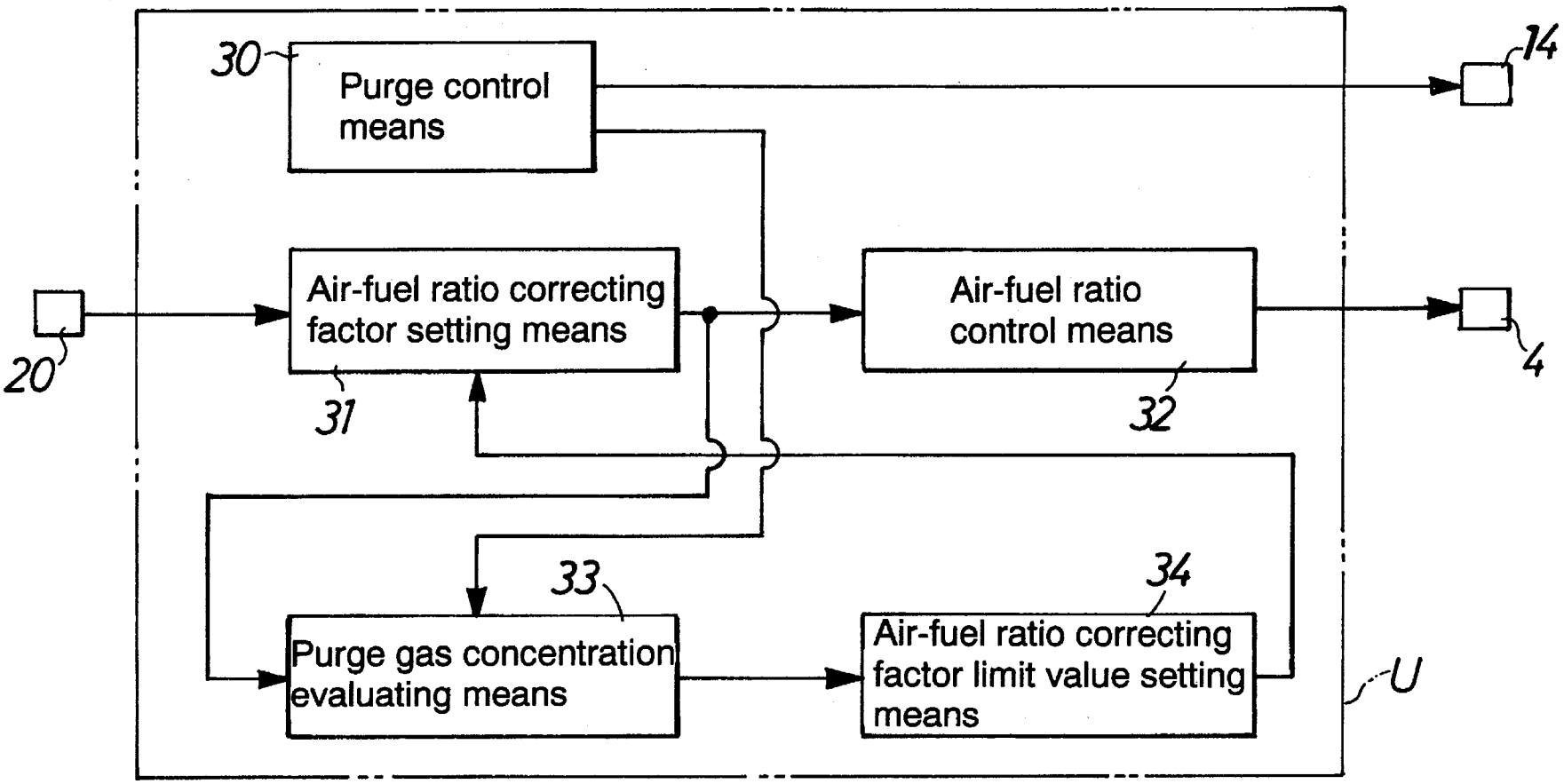
FIG. 2 is a block diagram illustrating a major arrangement section of an electronic control unit.

Referring to FIG. 2, the electronic control unit U has the following functions: as a purge control means 30 for controlling the operation of the purge control valve 14 to control the flow rate of the purge gas from the canister C to the intake system 5 of the engine E; as an air-fuel ratio correcting factor setting means 31 for determining an air-fuel ratio correcting factor in accordance with a detection value detected by the oxygen concentration sensor 20; as an air-fuel ratio control means 32 for controlling the air-fuel ratio of an air-fuel mixture into the engine E by determining the amount of fuel injected from the fuel injection valve 4 by use of the determined air-fuel ratio correcting factor; as a purge gas concentration estimating means 33 for receiving signals at the time of opening and closing of the purge control valve 14 from the purge control means 30, so as to estimate a purge gas concentration based on a) the air-fuel ratio correcting factor provided when the purge control valve 14 is in its opened state and b) the air-fuel ratio correcting factor provided when the purge control valve 14 is in its closed state; and as an air-fuel ratio correcting factor limit value setting means 34 for determining a lower limit value of the air-fuel ratio correcting factor determined by the air-fuel ratio correcting factor setting means 31 in accordance with the purge gas concentration estimated by the purge gas concentration estimating means 33.

The operational state of the engine E is determined by: the number $N_E$ of revolutions of the engine E detected by the revolution-number sensor 21; the intake gas temperature $T_A$ detected by the intake gas temperature sensor 22; the cooling water temperature detected by the water temperature sensor 23; the intake gas pressure $P_{BG}$ detected by the first intake gas pressure sensor 24; the atmospheric pressure $P_A$ detected by the atmospheric pressure sensor 25; the intake gas pressure $P_{BA}$ detected by the second intake gas pressure sensor 26; the battery voltage $V_B$ detected by the battery voltage sensor 27; the opening degree $\theta_{TH}$ of the throttle valve 6 detected by the throttle opening degree sensor 28 and the like. The purge control means 30 controls the opening and closing of the purge control valve 14 in accordance with the operational state of the engine E.

The air-fuel ratio control means 32 controls the amount of fuel injected by the fuel injection valve 4 by an open-loop control immediately after the start of the engine E, but after that, the air-fuel ratio control means 32 controls the amount of fuel injected by the fuel injection valve 4 by a feedback control based on the concentration of oxygen in the exhaust gas after the start of the engine E. In the feedback control, a time $T_{OUT}$ of injection of the fuel from the fuel injection valve 4 is calculated according to the following expression:

$$T_{OUT}=T_{IN}\times K_{02}\times K_1+K_2$$

wherein $T_{IN}$ is a reference time determined in accordance with the number $N_E$ of revolutions of the engine E and the intake gas pressure $P_{BA}$; $K_1$ and $K_2$ are a correcting factor and a correcting variable, respectively, which are determined in accordance with an indicator indicating the operational state of the engine E such as the opening degree of the throttle valve 6, and which are set to render characteristics optimal, such as a specific fuel consumption characteristic, and an accelerating characteristic depending upon the operational state of the engine E. Therefore, the amount of fuel injected from the fuel injection valve 4 is determined based on the fuel injection time $T_{OUT}$ and a fuel supply pressure.

An air-fuel ratio correcting factor $K_{02}$ in the above-described calculating expression carried out in the air-fuel ratio control means 32 is set by the air-fuel ratio correcting factor setting means 31. The air-fuel ratio correcting factor setting means 31 calculates the air-fuel ratio correcting factor $K_{02}$ in accordance with a procedure shown in FIGS. 3 to 5.

Figure 3:
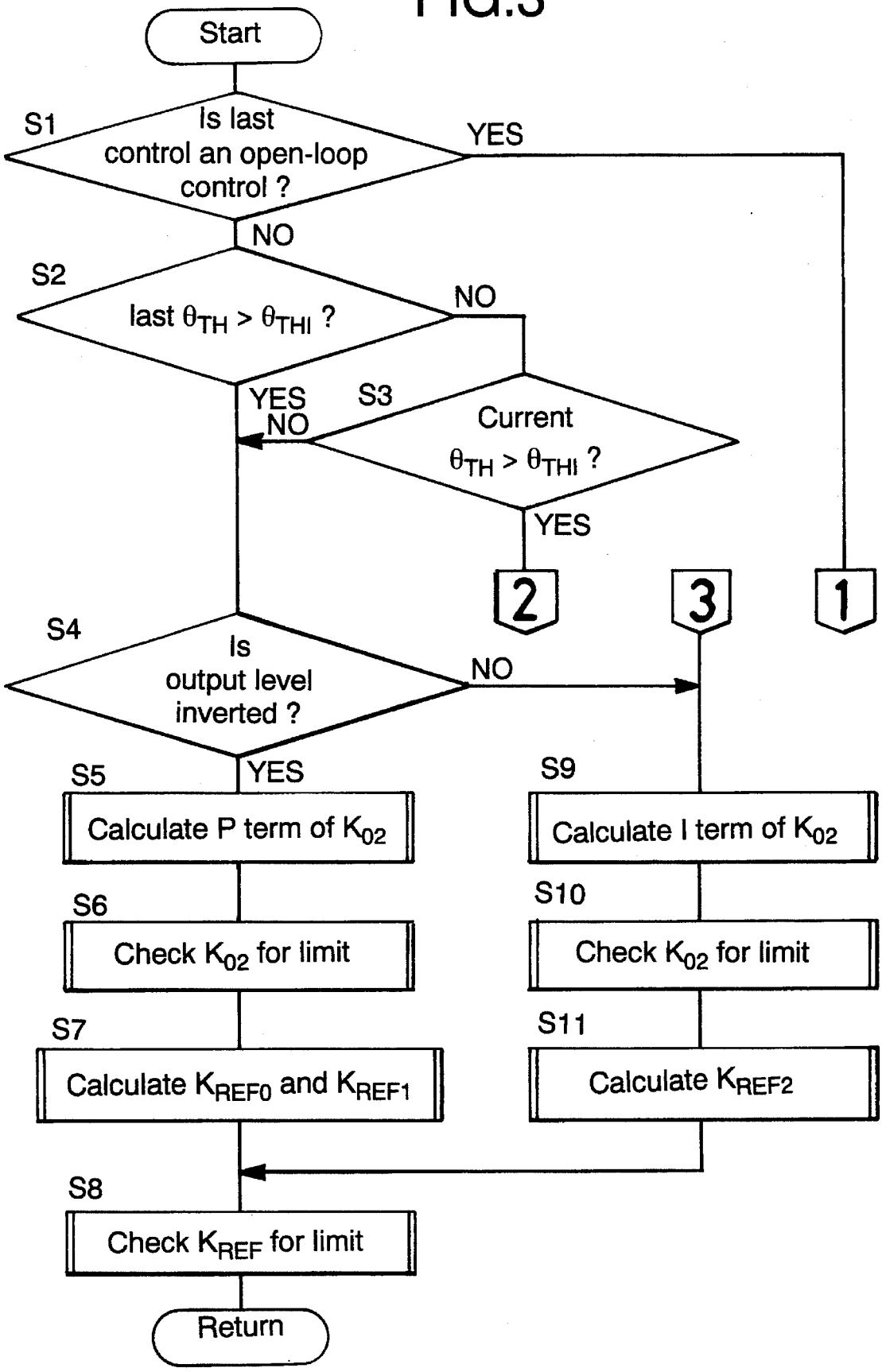
FIG. 3 is a portion of a flow chart illustrating a portion of an air-fuel ratio correcting factor calculating procedure.

Referring first to FIG. 3, at step S1, it is determined whether the last control is an open-loop control. If the last control is the open-loop control, processing is advanced to step S18 shown in FIG. 4. If the last control is a feedback control, it is determined at step S2 whether the last throttle opening degree $\theta_{TH}$ exceeds an idle opening degree $\theta_{THI}$ previously set in correspondence to an idle operation of the engine E. If $\theta_{TH}>\theta_{THI}$, processing is advanced to step S4. On the other hand, if $\theta_{TH}\leqq\theta_{THI}$, processing is advance to step S3, at which the current throttle opening degree $\theta_{TH}$ exceeds the present value $\theta_{THI}$. If $\theta_{TH}\leqq\theta_{THI}$, processing is advance to step S4. If $\theta_{TH}>\theta_{THI}$, processing is advanced to step S12 shown in FIG. 4. Thus, when the last throttle opening degree $\theta_{TH}$ exceeds the idle opening degree $\theta_{THI}$, as well as when the current throttle opening degree $\theta_{TH}$ is also equal to or less than the idle opening degree $\theta_{THI}$ even if the last throttle opening degree $\theta_{TH}$ is equal to or less than the idle opening degree $\theta_{THI}$, processing is advanced to step S4. When the last throttle opening degree $\theta_{TH}$ is equal to or less than the idle opening degree $\theta_{THI}$ and the current throttle opening degree $\theta_{TH}$ exceeds the idle opening degree $\theta_{THI}$, processing is advanced to step S12.

At step S4, it is detected whether the level of an output from the oxygen concentration sensor 20 for detecting the oxygen concentration $O_2$ has been inverted. If the output level has been inverted, a P term of the air-fuel ratio correcting factor $K_{02}$ is calculated at step S5, and based on the calculation result, the air-fuel ratio correcting factor $K_{02}$ is checked for its limit at step S6.

Then, a learning value $K_{REF0}$ of the air-fuel ratio correcting factor $K_{02}$ at the time when the engine is in an idle operational state, as well a learning value $K_{REF1}$ of the air-fuel ratio correcting factor $K_{02}$ at the time when the engine is in an operational state other than the idle operational state, are calculated at step S7. After that, the limit check for the learning values $K_{REF0}$ and $K_{REF1}$ is carried out at step S8.

If it is determined at step S4 that the level of the output from the oxygen concentration sensor 20 is not inverted, an I term of the air-fuel ratio correcting factor $K_{02}$ is calculated at step S9, and the limit check for the air-fuel ratio correcting factor $K_{02}$ is carried out based on the calculation result at step S10. The learning value $K_{REF2}$ of the air-fuel ratio correcting factor $K_{02}$ at the start of the engine operation is calculated at step S10 and then, the limit check for the learning value $K_{REF2}$ is carried out at step S8.

Figure 4:
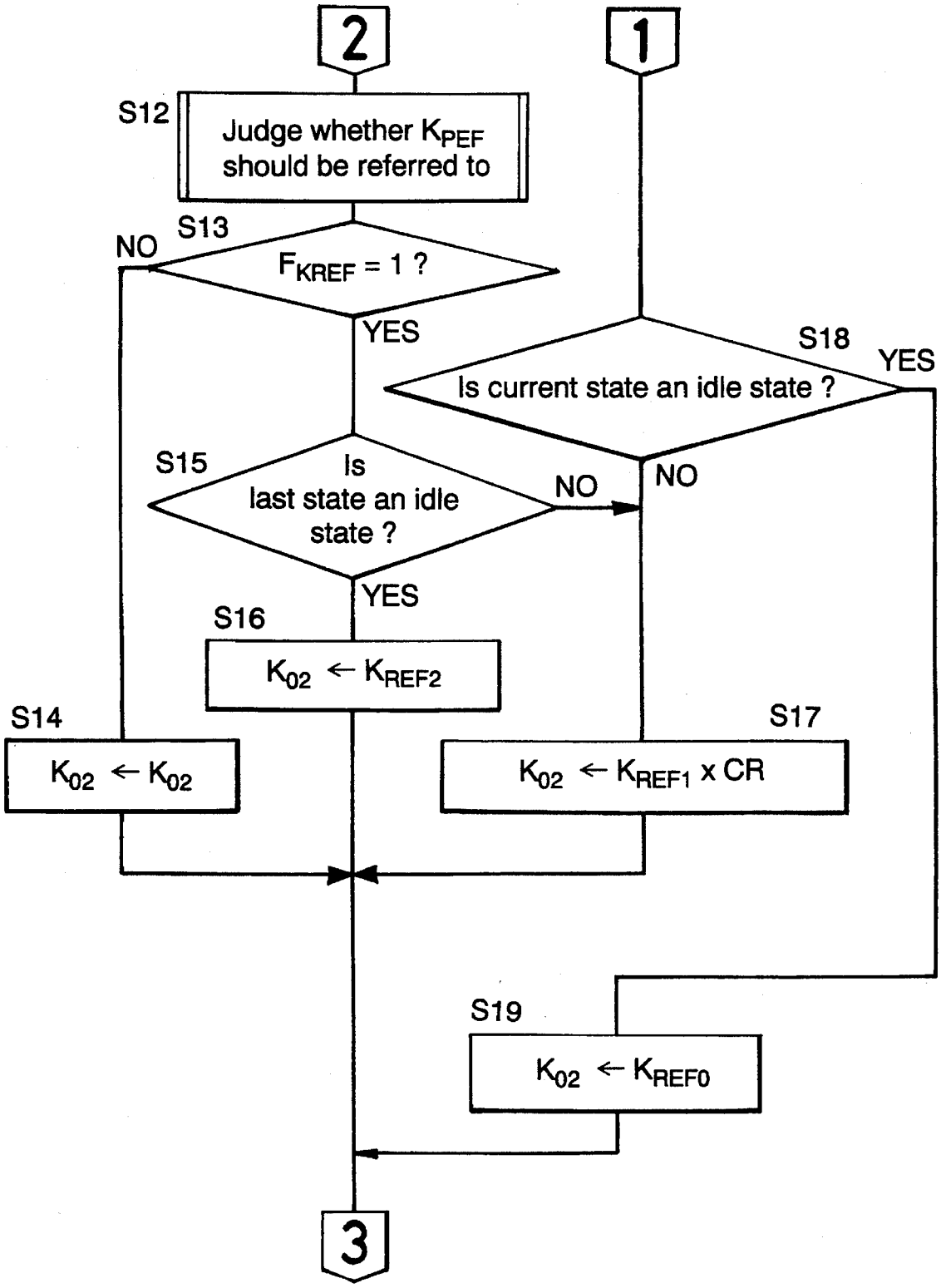
FIG. 4 is a portion of the flow chart illustrating the remaining portion of the air-fuel ratio correcting factor calculating procedure.

Referring to FIG. 4, at step S12, it is determined whether the learning value $K_{REF}$ which is a second factor should be referred to, and it is determined at step S13 whether a flag $F_{KREF}$ is "1". The flag $F_{KREF}$ indicates whether the learning value $K_{REF}$ is to be referred to. If the learning value $K_{REF}$ is to be referred to, the flag $F_{KREF}$ is "1". If $F_{KREF}=0$, the same value of the air-fuel ratio correcting factor $K_{02}$ is used as it is (i.e., $K_{02}=K_{02}$) at step S14, proceeding to step S9.

If $F_{KREF}=1$ at step S13, processing is advanced to step S15, at which it is determined whether the last operational state has been an idle state of the engine. If YES is determined at step S15, processing is advanced to step S16, at which the air-fuel ratio correcting factor $K_{02}$ is set at $K_{REF2}$, proceeding to step S9.

If it is determined at step S15 that the last operational state of the engine is not the idle state, processing is advanced from step S15 to step S17, at which the air-fuel ratio correcting factor $K_{02}$ is set at $K_{REF1}\times CR$, proceeding to step S9. CR is a constant for slightly enriching the air-fuel ratio.

Further, if it is determined at step S1 that the last control is the open-loop control, processing is advanced to step S18, at which it is determined whether the current operational state of the engine is an idle operational state. If NO is determined at step S18, processing is advanced to step S17. If YES is determined at step S18, processing is advanced to step S19 at which the air-fuel ratio correcting factor $K_{02}$ is set at $K_{REF0}$, proceeding to step S9.

Figure 5:
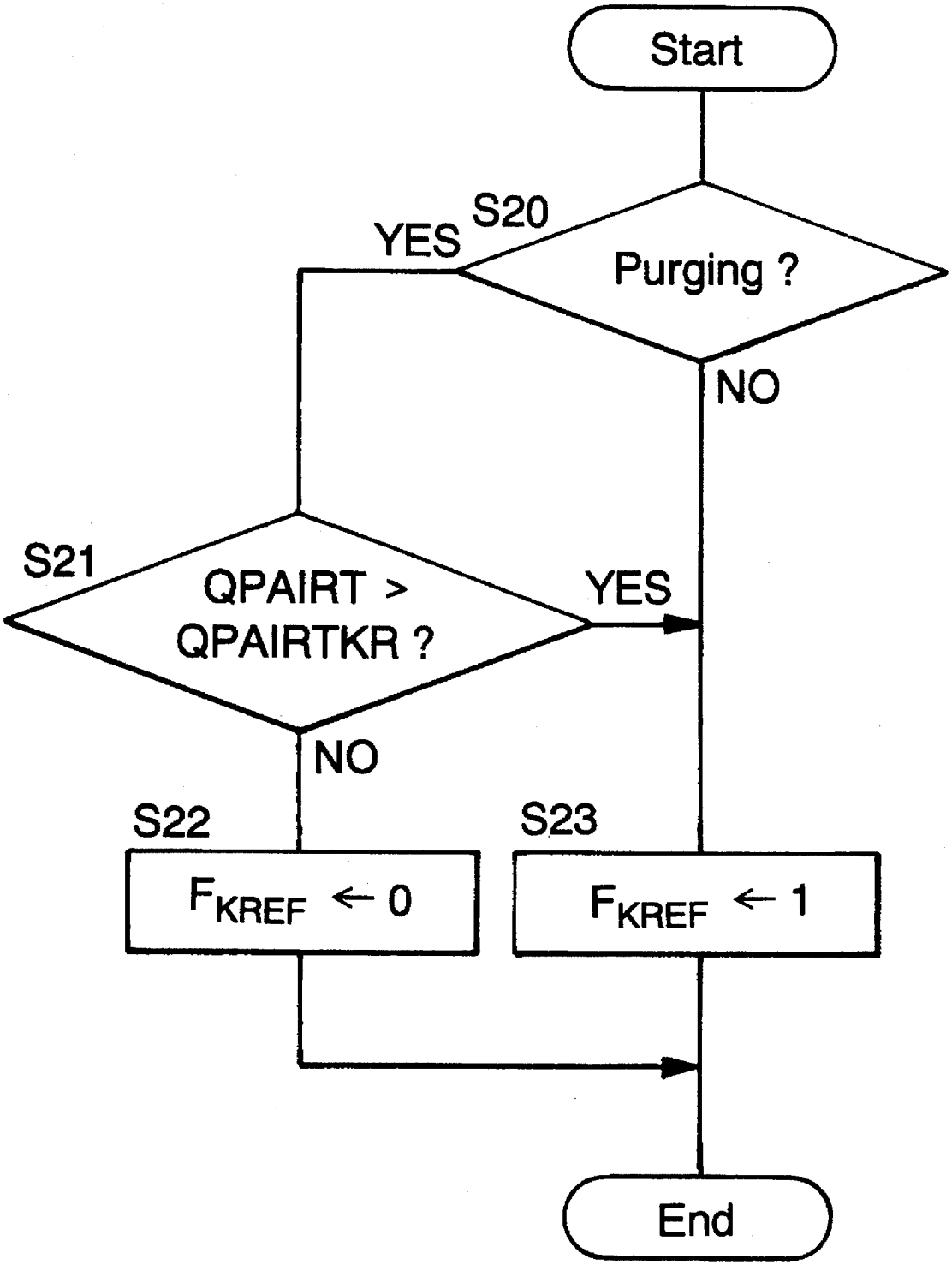
FIG. 5 is a flow chart illustrating a learning value reference-judgment subroutine.

A subroutine for carrying out the determination whether the learning value $K_{REF}$ should be referred to at step S12 in FIG. 4 is as shown in FIG. 5. At step S20, it is determined whether the purging from the purge passage 9 to the intake passage 5 is being carried out. If YES is determined at step S20, it is determined at step S21 whether a purge amount addition value QPAIRT exceeds a predetermined value QPAIRTKR. If QPAIRT≦QPAIRTKR, the flag $F_{KREF}$ is set to 0 (zero) at step S22. On the other hand, if QPAIRT>QPAIRTKR, as well as if it is determined at step S20 that purging is not being carried out, the flag $F_{KREF}$ is set to 1 at step S23.

According to such a subroutine shown in FIGS. 3 to 5, when the open-loop control is being carried out, the control of the air-fuel ratio is carried out using the learning value $K_{REF0}$ in place of the air-fuel ratio correcting factor $K_{02}$ during the idle operation, and using a value ($K_{REF1}$×CR) based on the learning value $K_{REF1}$ in place of the air-fuel ratio correcting factor $K_{02}$ during an operation other than the idle operation. When the control has been changed from the open-loop control to the feedback control, the control using the air-fuel ratio correcting factor $K_{02}$ is carried out in a condition in which a large throttle opening degree $\theta_{TH}$ or a small throttle opening degree $\theta_{TH}$ is maintained. When the throttle opening degree $\theta_{TH}$ has been changes from a small value to a large value, i.e., in particular operational state such as at the start of the engine, the control is carried out using no learning value, when the purge amount addition value QPAIRT is equal to or less than the predetermined value QPAIRTKR, and using the value $K_{REF2}$ or the value ($K_{REF1}$×CR) in place of the air-fuel ratio correcting factor $K_{02}$ depending upon whether the operational state is the idle operational state, when QPAIRT>QPAIRTKR.

Figure 6:
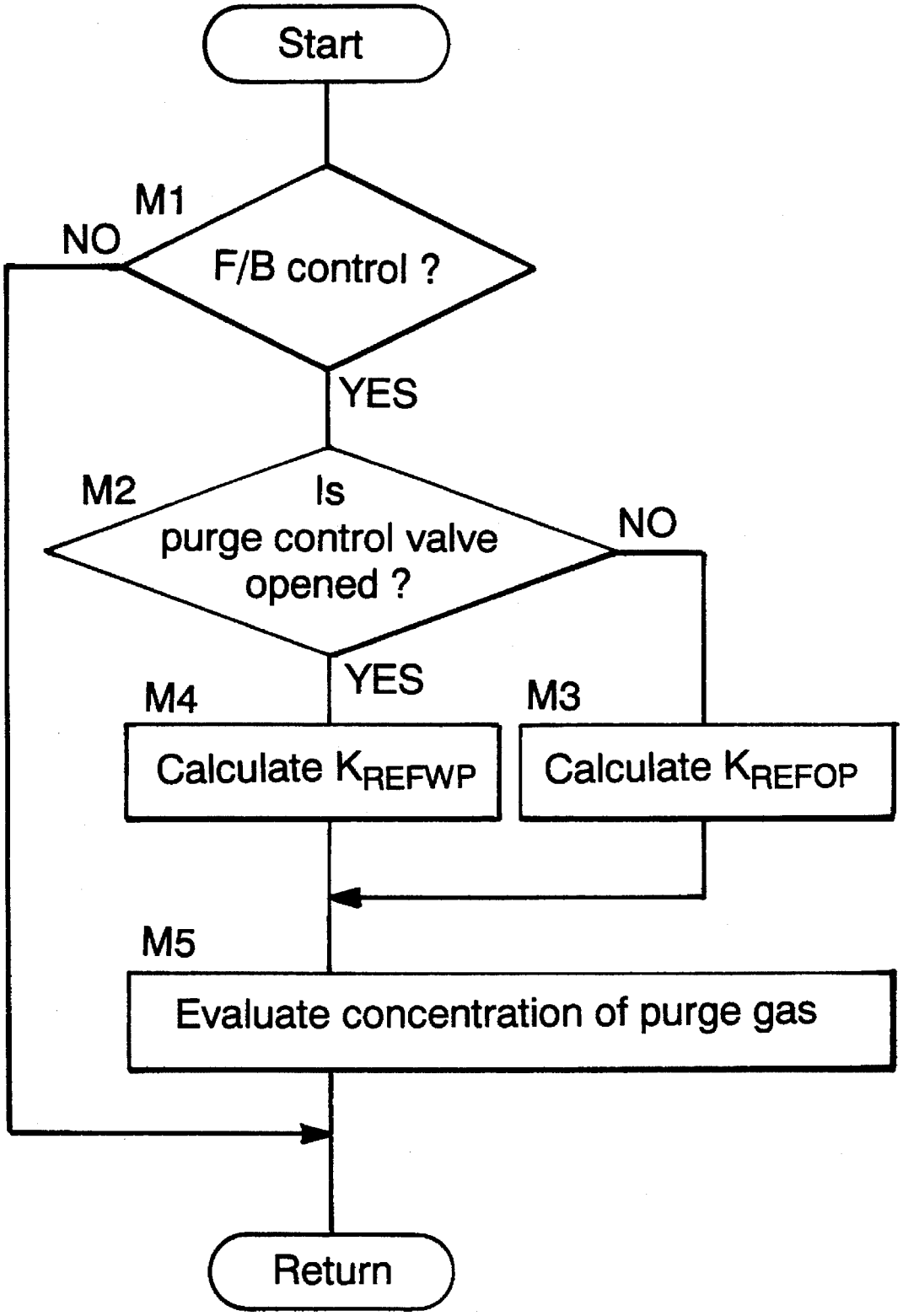
FIG. 6 is a flow chart illustrating a purge gas concentration estimating procedure.

In the purge gas concentration estimating means 33, a purge gas concentration is estimated according to a procedure shown in FIG. 6. First, at step M1, it is determined whether the amount of fuel injected from the fuel injection valve 4 is being controlled by feedback control. If feedback control is being carried out, it is determined at step M2 whether the purge control valve 14 is in its opened state.

If it is determined at step M2 that the purge control valve 14 is in its closed state, an average value $K_{REFOP}$ of the air-fuel ratio correction factors $K_{02}$ in the closed state of the purge control valve 14 is calculated at step M3. On the other hand, if it is determined at step M2 that the purge control valve 14 is in its opened state, an average value $K_{REFWP}$ of the air-fuel ratio correction factors $K_{02}$ in the opened state of the purge control valve 14 is calculated at step M4.

At step M5 after steps M3 and M4, a purge gas concentration is estimated based on a difference ($K_{REFOP}$–$K_{REFWP}$) between the average value $K_{REFOP}$ of the air-fuel ratio correcting factors in the closed state of the purge control valve 14 and the average value $K_{REFWP}$ of the air-fuel ratio correcting factors in the opened state of the purge control valve 14. The difference ($K_{REFOP}$–$K_{REFWP}$) indicates the degree of enrichment of the air-fuel ratio of the air-fuel mixture supplied to the engine E with the opening of the purge control valve 14. As the difference ($K_{REFOP}$–$K_{REFWP}$) is larger, the concentration of the purge gas is higher. Thus, the purge gas concentration is estimated based on the air-fuel ratio correcting factors $K_{02}$ in the opened and closed states of the purge control valve 14 by the purge gas concentration estimating means 33.

Figure 7:
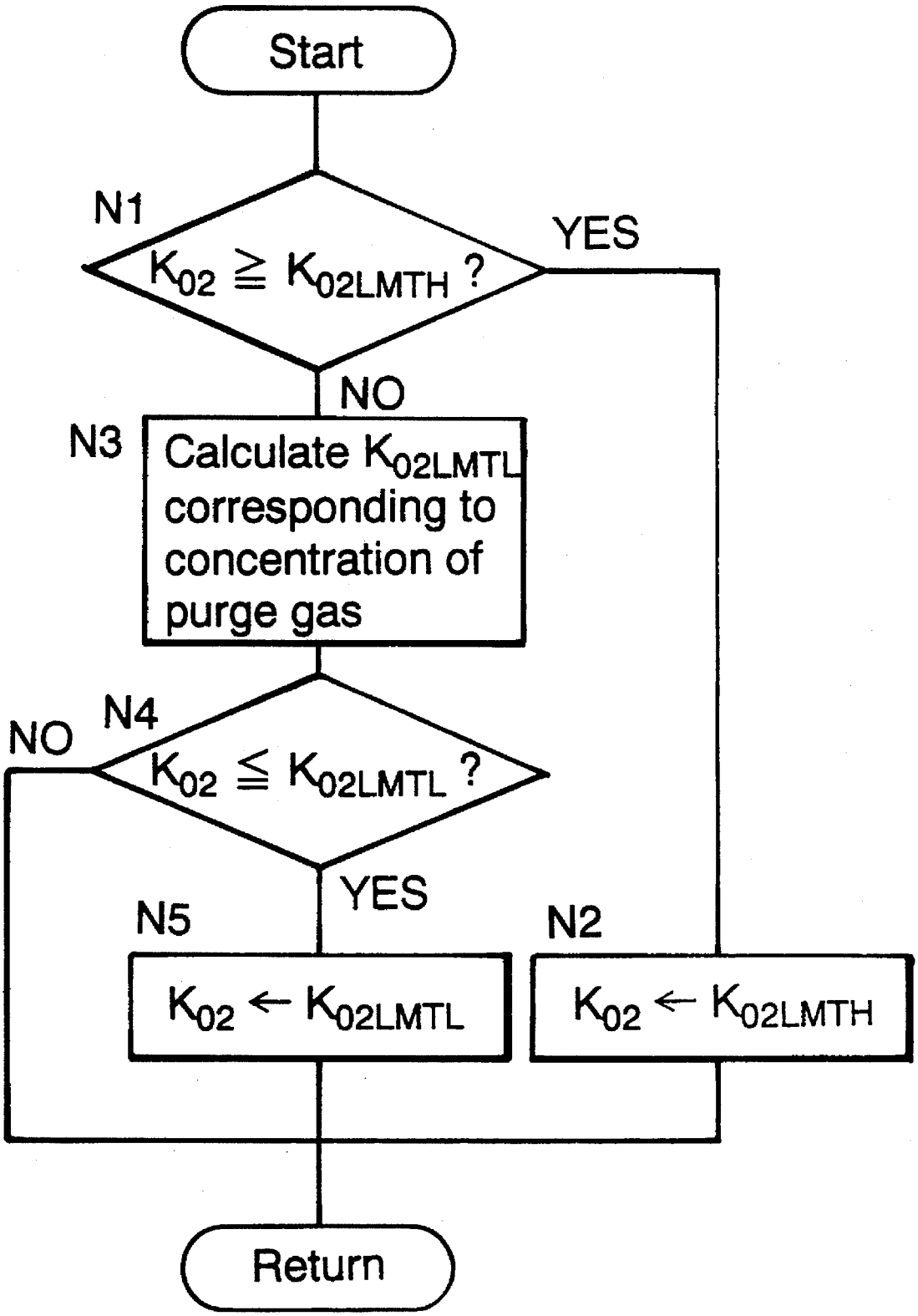
FIG. 7 is a flow chart illustrating a procedure for determining a limit value of an air-fuel ratio correcting factor.
Figure 8:
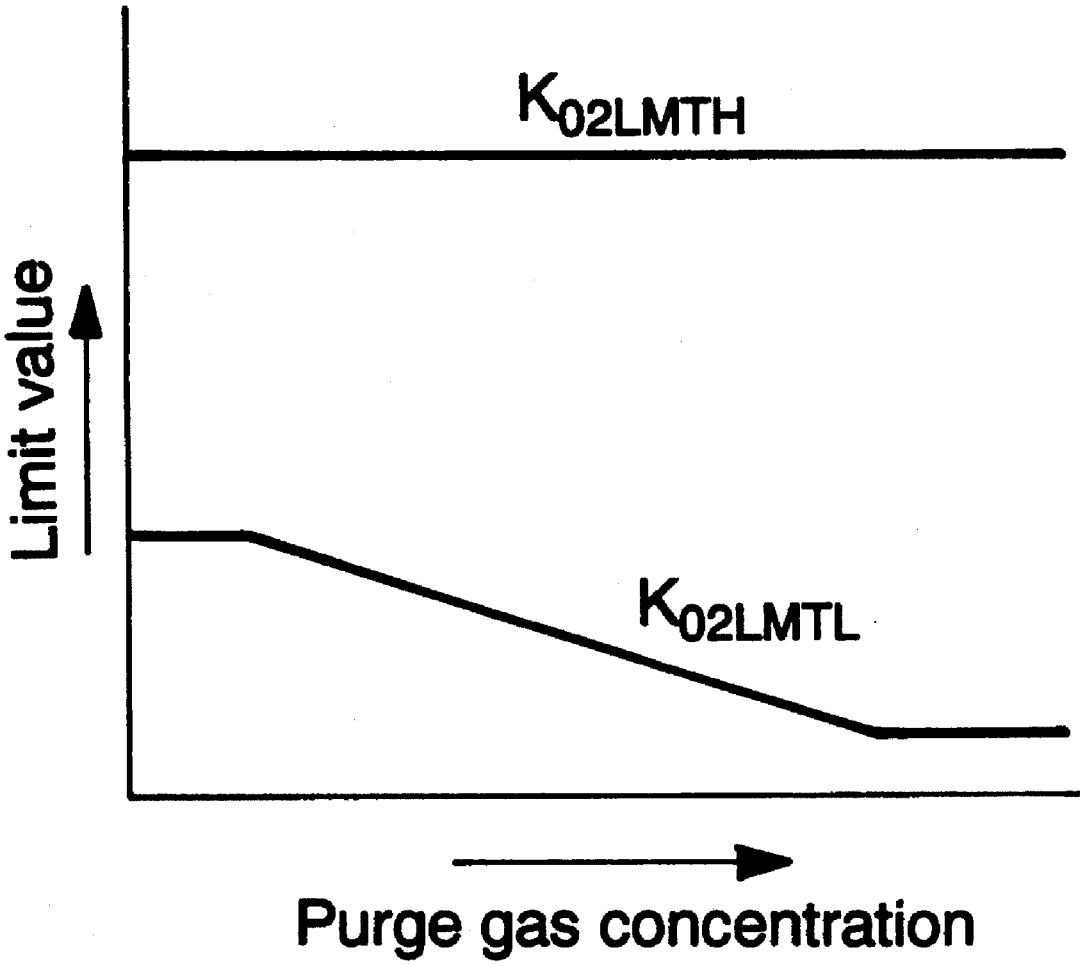
FIG. 8 is a diagram illustrating a pre-established map of the air-fuel ratio correcting factor limit value in accordance to the concentration of a purge gas.

In the air-fuel ratio correcting factor limit value setting means 34, upper and lower limit values of the air-fuel ratio correcting factor are set according to a procedure shown in FIG. 7. First, at step N1, it is determined whether the air-fuel ratio correcting factor $K_{02}$ is equal to or greater than an upper limit value $K_{02LMTH}$. As shown in FIG. 8, the upper limit $K_{02LMTH}$ of the air-fuel ratio correcting factor $K_{02}$ is determined at a constant value irrespective of the purge gas concentration. A lower limit value of $K_{02LMTL}$ of the air-fuel ratio correcting factor $K_{02}$ is determined in a certain range of the purge gas concentration, so that it is reduced as the purge gas concentration is increased. If it is determined at step N1 that $K_{02}$≧$K_{02LMTH}$, the air-fuel ratio correcting factor $K_{02}$ is determined at the upper limit $K_{02LMTH}$ ($K_{02}$=$K_{02LMTH}$) at step N2.

If it is determined at step N1 that $K_{02}$<$K_{02LMTH}$ at step N1, a lower limit value $K_{02LMTL}$ according to the purge gas concentration is calculated based on a map shown in FIG. 8 at step N3. At step N4 a determination is made whether the air-fuel ratio correcting factor $K_{02}$ is equal to or less than the lower limit value $K_{02LMTL}$. If $K_{02}$≦$K_{02LMTL}$, the air-fuel ratio correcting factor $K_{02}$ is determined at the lower limit value $K_{02LMTL}$ ($K_{02}$=$K_{02LMTL}$).

The operation of this embodiment will be described below. The degree of enrichment of the air-fuel ratio of the air-fuel mixture, supplied to the engine E with the opening of the purge control valve 14, is represented by the difference ($K_{REFOP}$–$K_{REFWP}$) between the average value $K_{REFOP}$ of the air-fuel ratio correcting factors in the closed state of the purge control valve 14 and the average value $K_{REFWP}$ of the air-fuel ratio correcting factors in the opened state of the purge control valve 14. In the purge gas concentration estimating means 33, the purge gas concentration is estimated in accordance with the difference ($K_{REFOP}$–$K_{REFWP}$). Moreover, the lower limit value $K_{02LMTL}$ of the air-fuel ratio correcting factor $K_{02}$ set by the air-fuel ratio correcting factor setting means 31 is determined by the air-fuel ratio correcting factor limit value setting means 34 in accordance with the purge gas concentration estimated by the purge gas concentration estimating means 33. Thus, the lower limit value $K_{02LMTL}$ of the air-fuel ratio correcting factor $K_{02}$ is determined in correspondence to the degree of enrichment of the air-fuel ratio varied depending upon the concentration of the purge gas.

Therefore, in the prior art when the lower limit value is set constant, a canister break-through due to a reduction in exhaust gas purifying performance may be caused in some cases by an over-enrichment, by the mis-detection of a problem in a fuel supply system, or by an unnecessary reduction in flow rate of the purge gas immediately after the start of purging of the canister, during a long idle operation as well as immediately after leaving the long idle operation, particularly due to an increase in size of the canister and an increase in flow rate of the purge gas. In the system according to the present invention, however, such a problem can be overcome.

Moreover, in a system in the prior art in which the lower limit value is always decreased when the purging is carried out, even when the concentration of the purge gas is lower, the lower limit value may be decreased, resulting in a reduced control responsiveness of the control of the air-fuel ratio into a target air-fuel ratio. To the contrary, in the system according to the present invention, the lower limit value of the air-fuel ratio correcting factor can be varied in accordance with the concentration of the purge gas to enhance the responsiveness of the control of the air-fuel ratio, and it is possible to set an air-fuel ratio control range depending upon the concentration of the purge gas, i.e., the degree of enrichment of the air-fuel ratio.

Although the embodiment of the present invention has been described in detail, it will be understood that the present invention is not limited to the above-described embodiment, and various modifications may be made without departing from the spirit and scope of the invention defined in claim.

What is claimed is:

1. An evaporative fuel control system in an internal combustion engine, comprising:

a canister for adsorbing an evaporative fuel from a fuel tank;

a purge control valve provided between an intake system of the engine and said canister;

a purge control means for controlling operation of said purge control valve to control a flow rate of a purge gas from said canister to said intake system;

an exhaust gas concentration sensor provided in an exhaust system of the engine;

an air-fuel ratio correcting factor setting means for determining an air-fuel ratio correcting factor in accordance with a detection value detected by said exhaust gas concentration sensor;

an air-fuel ratio control means for controlling an air-fuel ratio of an air-fuel mixture supplied to the engine by use of the determined air-fuel ratio correcting factor;

a purge gas concentration estimating means for estimating a purge gas concentration based on said air-fuel ratio correcting factor provided when said purge control valve is opened and said air-fuel ratio correcting factor provided when said purge control valve is closed; and an air-fuel ratio correcting factor limit value setting means for determining a lower limit value of the air-fuel ratio correcting factor set by said air-fuel ratio correcting factor setting means in accordance with the purge gas concentration estimated by said purge gas concentration estimating means.

2. An evaporative fuel control system according to claim 1, wherein said purge gas concentration estimating means estimates said purge gas concentration based upon a degree of enrichment of the air-fuel ratio of the air-fuel mixture.

3. An evaporative fuel control system according to claim 1, wherein said purge gas concentration estimating means estimates said purge gas concentration based on a difference between an average value of the air-fuel ratio correcting factors in the closed and in the opened states of the purge control valve.

4. An evaporative fuel control system according to claim 1, wherein said air-fuel ratio correcting factor limit value setting means reduces the lower limit value of the air-fuel ratio correcting factor as the purge gas concentration is increased.

5. An evaporative fuel control system according to claim 1, wherein said lower limit value of the air-fuel ratio correcting factor is varied based upon the purge gas concentration.

6. An evaporative fuel control system according to claim 1, wherein said lower limit value of the air-fuel ratio correcting factor is varied based upon a degree of enrichment of the air-fuel ratio.

7. An evaporative fuel control system according to claim 1, wherein said air-fuel ratio correcting factor limit value setting means for determining an upper limit value of the air-fuel ratio correcting factor at a constant value irrespective of the purge gas concentration.

* * * * *